US006584656B1

(12) United States Patent
Karmeli

(10) Patent No.: US 6,584,656 B1
(45) Date of Patent: Jul. 1, 2003

(54) ORNAMENT CLUTCH

(76) Inventor: David D. Karmeli, 137 Duane St., Suite 201, New York, NY (US) 10013

( * ) Notice: Subject to any disclaimer, the term of this patent is extended or adjusted under 35 U.S.C. 154(b) by 0 days.

(21) Appl. No.: 10/177,914

(22) Filed: Jun. 20, 2002

(51) Int. Cl.[7] ..... A44C 7/00

(52) U.S. Cl. ..... 24/705; 24/601.5; 24/707.2; 24/706.9; 63/12; 63/13

(58) Field of Search ..... 24/705, 706.9, 24/707.5, 707.2, 671, 297, 573.1, 499, 601.5, 685; 63/12, 13

(56) References Cited

U.S. PATENT DOCUMENTS 1,358,465 A * 11/1920 Reston ..... 24/707.5
1,433,790 A * 10/1922 Carr ..... 24/671
3,417,439 A * 12/1968 Seckerson ..... 24/297
4,425,687 A * 1/1984 Sauer ..... 63/12
4,630,452 A * 12/1986 Connelly et al. ..... 63/12
4,686,837 A * 8/1987 Carre ..... 63/12
5,845,378 A * 12/1998 Karmeli et al. ..... 24/705
6,389,662 B1 * 5/2002 Hamm, Jr. ..... 24/705
6,457,217 B2 * 10/2002 Yoshii et al. ..... 24/297

* cited by examiner

*Primary Examiner*—Victor Sakran
(74) *Attorney, Agent, or Firm*—Notaro & Michalos P.C.

(57) ABSTRACT

A clutch for an earring or other ornament post has a resilient pincer disk with an opening defining a pair of arms connected to each other by a resilient bridge. The arms have arcuate surfaces to engage the post. A V-shaped opening extends from the arms and contains a wedge movable for spreading the pincer arms to release the post. A holder receives the wedge and disk and for holding the wedge in engagement with the disk and a part of the wedge extends beyond the holder and defines an activation button to be pushed for moving the wedge with respect to the disk.

16 Claims, 2 Drawing Sheets

ORNAMENT CLUTCH

FIELD AND BACKGROUND OF THE INVENTION

The present invention relates in general to a new and useful clasp or clutch for the post of an earring for pierced ears or other ornament such as a tie tack or other pierced body ornament.

U.S. Pat. No. 5,845,378 to Karmeli et al. discloses a clasp for an earring post with a C-shaped resilient pincer disk which engages the post. A washer with a hole therethrough is stacked with the pincer disk and both the disk and washer are held within a resilient elastic holder. This patent will be referred to herein as the '378 patent and is incorporated herein by reference.

It is known to provide a post for ornaments to be worn on the ears such as earrings, which are straight and extend through a hole in the ear. It is also known to hold the post on the ear by placing a clasp, clutch or clamp onto the end of the post. The '378 patent illustrates various conventional clasps for the post of an earring. The clasp on one of the prior art structures, includes a disk-shaped base to which it is connected, for example by soldering, a curved double-armed loop of springy metal which has arms that engage opposite sides of the post end.

Another known clasp has a disk with a hole therethrough for receiving the post, and a pair of spring-loaded and complex pushbuttons to engage and release the post.

Another conventional design utilizes a bulbous catch which has an opening therethrough and internal compression parts which squeeze against the post to hold the clasp on the post.

A need remains for an inexpensive and effective ornament post clasp which also improves the clutch of the '378 patent by providing a positive mechanism for engaging and disengaging the post while avoiding the cost and complexity of the known push-button clasps.

SUMMARY OF THE INVENTION

It is an object of the present invention to provide a clutch for an ornament post which comprises a pincer disk made of resilient material and having an opening therein defining a pair of pincer arms that are connected to each other by a resilient bridge. The arms each have a pincer surface adapted to engage the post so that the pincer surfaces of the arms are on opposite sides of the post when the disk is in an engagement position on the post. The bridge has a resiliency for biasing the arms toward each other and for biasing the pincer surfaces against the post, the disk having an open position with the pincer surfaces spaced a part for receiving the post therebetween, and at least one engagement surface spaced from the pincer surfaces. A wedge is engagable with the engagement surface and movable with respect to the disk for moving the disk between the engagement position and the open position and a holder receives the wedge and the disk and holds the wedge for engagement with the engagement surface of the disk. At least part of the wedge extends beyond the holder and defines an activation button to be pushed for moving the wedge with respect to the disk.

Although most commonly used for the post of an earring for pierced ears, the clutch of the invention can be used for a post of an other ornament such as a tie tack or other pierced body ornament.

Another object of the invention is to provide such a clutch wherein the holder has a hole therethrough which is aligned with the pincer surfaces for receiving the post. The holder comprises a housing for containing the wedge and disk, the housing having a passage for the activation button on one side, and a projection of a shape similar to that of the button on an opposite side. The holder may include a closing plate engaged with the housing for defining a space for the disk and the wedge, the plate having a hole therethrough aligned with a hole in the housing and together forming the hole in the holder for the post.

According to a further object of the invention, a washer is provided in the housing space and is engaged against the disk and wedge for maintaining alignment of the disk and wedge.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
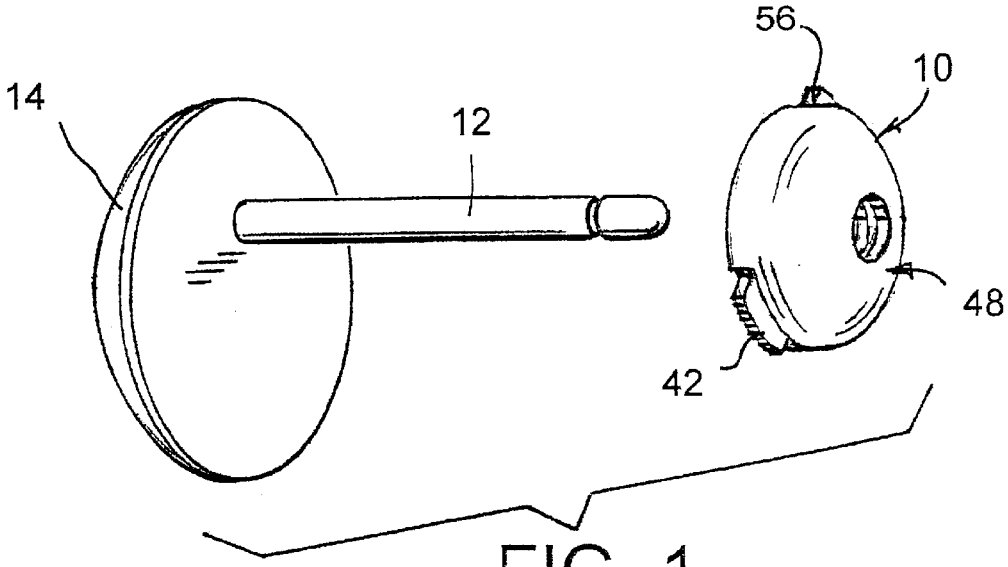
FIG. 1 is an exploded view of the clutch of the invention for use on the post of an ornament, such as an earring for a pierced ear or other pierced body part.

Referring now to the drawings, the invention embodied in FIG. 1 is an earring post clutch generally designated 10, for an earring post 12 having a selected diameter and extending from the back of an ornament such as an earring 14.

Figure 2:
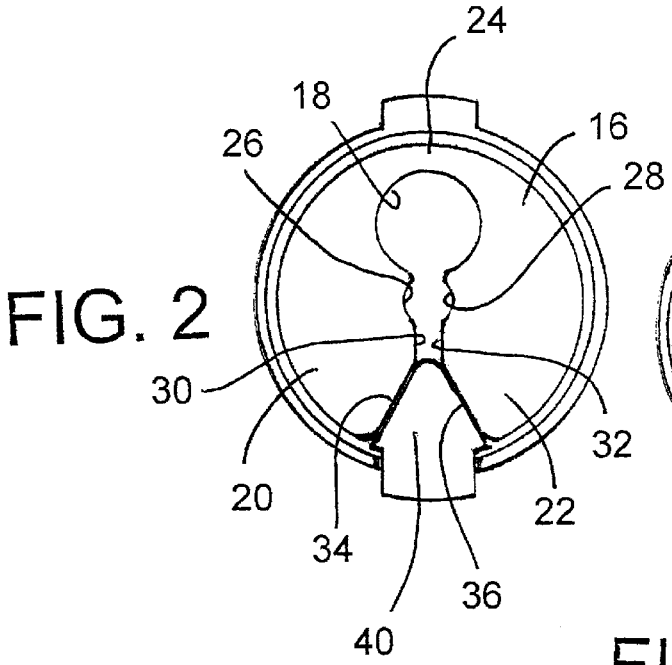
FIG. 2 is a plane view of a disk and wedge of the invention, inside a housing part of a holder of the clutch, and with the disk in an engagement position for engaging a post.
Figure 3:
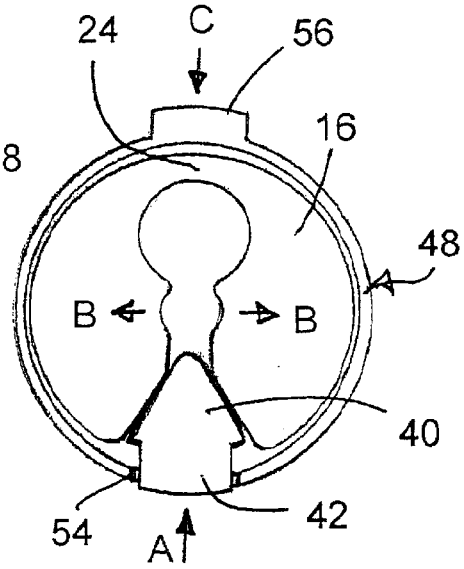
FIG. 3 is a view similar to FIG. 2, but with the wedge moved and of the disk in an open position for releasing the post.

Turning to FIG. 2, the clutch comprises a pincer disk 16 made of resilient metal such as gold or silver, and having an opening 18 therein, defining a pair of pincer arms 20, 22, that are connected to each other by a resilient bridge 24. The arms each having an arcuate, concave pincer surface 26 and 28, adapted to engage the post diameter. To this end, the pincer surfaces are on opposite sides of the post and hold the post firmly when the disk is in its engagement position as shown in FIG. 2 (although the post itself is not shown for clarity in FIGS. 2 and 3).

The opening 18 in the disk 16 may be circular or oval or any other appropriate shape, as long a resilient bridge 24 is created.

Each arm 20 and 22, has a straight edge 30, 32, adjacent its respective pincer surface 26 and 28, defining a slot between the arms, and an outwardly inclined engagement surface 34 and 36, defining a V-shaped opening into said slot. A generally triangular wedge 40 is engaged in the V-shaped opening and is movable in the direction of arrow A in FIG. 3, for spreading the pincer arms in the direction of arrows B, to release the post.

A holder 48 for receiving the wedge and the disk and for holding the wedge for engagement with the disk is also part of the clutch. At least part of the wedge extends beyond the holder 48, and defines an activation button 42 to be pushed in direction A for moving the wedge with respect to the disk and opening arms 20, 22. As shown in FIG. 1, the outer surface of the button 42 may be knurled, serrated or roughened to increase friction with the fingers.

Figure 4:
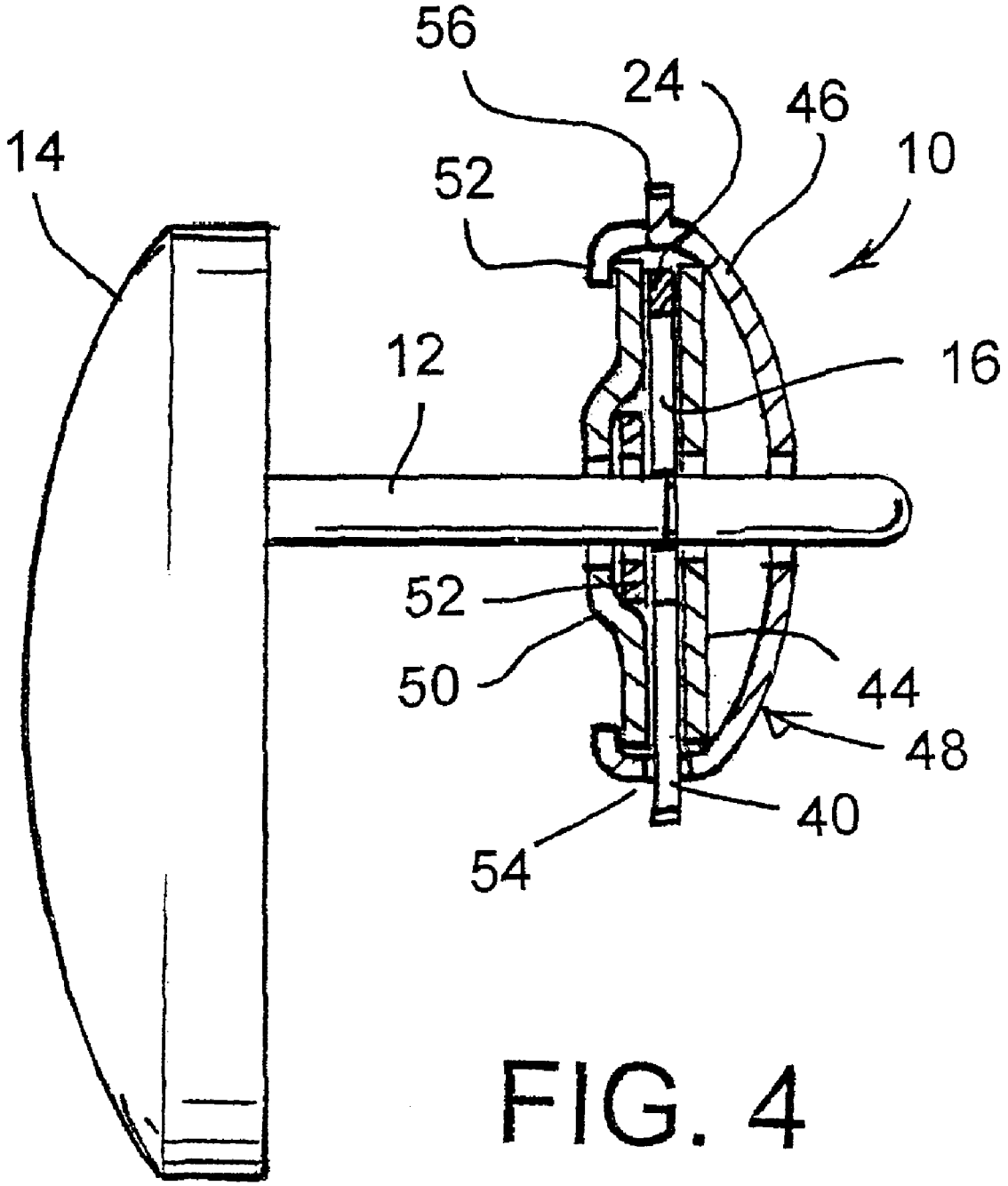
FIG. 4 is a sectional view of the clutch of the invention engaged to an earring post.

As illustrated in FIG. 4, the holder 48 also contains a washer 44 engaged against the aligned disk and wedge which are both metal, flat structures with aligned top and bottom surfaces.

The disk, the wedge, the holder and the washer are made of metal and preferably gold or silver for use in precious metal jewelry.

Holder 48 includes a dome-shaped housing 46 and a closing plate 50 engaged to each other by a bent-over rim 52 on the housing. The rim may be carried by the plate, however. The housing and plate-define a space for the disk, the wedge and the washer. Plate 50 has a recess therein adjacent the disk with a ring 52 in the recess for engaging the disk to help hold the washer, the disk and the wedge in a near, aligned stack between the housing and the plate.

The housing, plate, washer and ring have holes therein as shown in FIG. 4, that are aligned with the pincer surfaces for receiving the post 12 through the holder 48. The housing has a slit or passage 54 for the button 42 to extend outside the housing and the housing includes a projection 56 shaped like the button 42 and on an opposite side of the housing 46 from the button for facilitating pressing of the button in direction A, as the projection 56 is pressed in the opposite direction C. This also helps the wearer find the activation button 42 in that it is more natural to squeeze the button 42 against the button-like projection 56 than to press the button 42 only.

As noted, although used for the illustrated embodiment of an earring, the clutch of the invention can be used for a post of an other ornament such as a tie tack or other pierced body ornament.

While a specific embodiment of the invention has been shown and described in detail to illustrate the application of the principles of the invention, it will be understood that the invention may be embodied otherwise without departing from such principles.

What is claimed is:

1. A clutch for an ornament post, the clutch comprising:

a pincer disk made of resilient material and having an opening therein defining a pair of pincer arms that are connected to each other by a resilient bridge, the arms each having a pincer surface adapted to engage the post so that the pincer surfaces of the arms are on opposite sides of the post when the disk is in an engagement position on the post;

the bridge having a resiliency for biasing the arms toward each other and for biasing the pincer surfaces against the post, the disk having an open position with the pincer surfaces spaced apart for receiving the post therebetween, and at least one engagement surface spaced from the pincer surfaces;

a wedge engagable with the engagement surface and movable with respect to the disk for moving the disk between the engagement position and the open position; and a holder for receiving the wedge and the disk and for holding the wedge for engagement with the engagement surface of the disk, at least part of the wedge extending beyond the holder and defining an activation button to be pushed for moving the wedge with respect to the disk.

2. A clutch according to claim 1, wherein the holder has a hole therethrough which is aligned with the pincer surfaces for receiving a post.

3. A clutch according to claim 2, wherein the holder comprises a housing for containing the wedge and disk, the housing having a passage for the activation button on one side, and a projection of a shape similar to that of the button on an opposite side.

4. A clutch according to claim 3, wherein the holder includes a closing plate engaged with the housing for defining a space for the disk and the wedge, the plate having a hole therethrough aligned with a hole in the housing and together forming the hole in the holder for a post.

5. A clutch according to claim 4, including a washer in the space, engaged against the disk and wedge for maintaining alignment of the disk and wedge with each other.

6. A clutch according to claim 5, wherein the disk is made of resilient metal.

7. A clutch according to claim 1, wherein the disk includes a pair of facing engagement surfaces which diverge from the pincer surfaces, the wedge being between the diverging engagement surfaces.

8. A clutch according to claim 1, wherein the pincer surfaces are each arcuate concave recesses that face each other.

9. A clutch according to claim 1, wherein the holder comprises a housing having a passage for the activation button, the wedge including at least one stop for engaging the housing adjacent the passage for retaining the wedge in the housing.

10. A clutch according to claim 9, wherein the wedge is metal and is generally triangular.

11. A post clutch for an ornament post having a diameter, the clutch comprising:

a pincer disk made of resilient metal and having an opening therein defining a pair of pincer arms that are connected to each other by a resilient bridge;

the arms each having an arcuate, concave pincer surface adapted to engage the post so that the pincer surfaces of said arms are on opposite sides of the post when the disk is in an engagement position on the post, the opening in the disk being circular or oval;

each arm having a straight edge adjacent a pincer surface defining a slot between the arms, and an outwardly inclined surface defining a V-shaped opening into said slot;

a wedge engaged in the V-shaped opening and movable for spreading the pincer arms to release the post; and a holder for receiving the wedge and the disk and for holding the wedge for engagement with the disk, at least part of the wedge extending beyond the holder and defining an activation button to be pushed for moving the wedge with respect to the disk.

12. A clutch according to claim 11, including a washer in the holder.

13. A clutch according to claim 12, wherein the disk, the wedge, the holder and the washer are made of metal.

14. A clutch according to claim 13, wherein the holder includes a housing and a closing plate engaged to each other by a rim on one of the housing and plate and defining a space for the disk, the wedge and the washer, the plate having a recess therein adjacent the disk, the clutch including a ring in the recess for engaging the disk.

15. A clutch according to. claim 14, wherein the housing is dome-shaped and the housing, plate, washer and ring have holes therein that are aligned with the pincer surfaces for receiving the post through the holder.

16. A clutch according to claim 15, wherein the housing has a slit for the button to extend outside the housing, the housing including a projection shaped like the button and on an opposite side of the housing from the button for facilitating pressing of the button.

* * * * *